US006592203B1

(12) United States Patent
Bates et al.

(10) Patent No.: US 6,592,203 B1
(45) Date of Patent: Jul. 15, 2003

(54) SUBCOVERED PRINTING MODE FOR A PRINTHEAD WITH MULTIPLE SIZED EJECTORS

(75) Inventors: John Booth Bates, Harrodsburg, KY (US); Scott Michael Heydinger, Lexington, KY (US); Randall David Mayo, Georgetown, KY (US); Michael Anthony Marra, III, Lexington, KY (US); Richard Lee Reel, Georgetown, KY (US)

(73) Assignee: Lexmark International, Inc., Lexington, KY (US)

( * ) Notice: Subject to any disclaimer, the term of this patent is extended or adjusted under 35 U.S.C. 154(b) by 0 days.

(21) Appl. No.: 10/074,923

(22) Filed: Feb. 11, 2002

(51) Int. Cl.[7] ..... B41J 2/15
(52) U.S. Cl. ..... 347/40; 347/41; 347/12
(58) Field of Search ..... 347/40, 12, 41, 347/16, 15, 43, 9; 358/1.2, 1.9, 502

(56) References Cited

U.S. PATENT DOCUMENTS

| | | | | |
|---|---|---|---|---|
| 4,631,548 A | | 12/1986 | Milbrandt | 347/43 |
| 5,239,312 A | | 8/1993 | Merna et al. | 347/43 |
| 5,600,351 A | | 2/1997 | Holstun et al. | 347/40 |
| 5,731,827 A | | 3/1998 | Mantell et al. | 347/40 |
| 5,767,870 A | | 6/1998 | Klassen et al. | 347/9 |
| 5,971,524 A | | 10/1999 | Nicoloff, Jr. et al. | 347/43 |
| 5,988,790 A | | 11/1999 | Koike et al. | 347/41 |
| 6,030,065 A | * | 2/2000 | Fukuhata | 347/15 |
| 6,053,596 A | | 4/2000 | Nakano et al. | 347/15 |
| 6,126,263 A | | 10/2000 | Hotomi et al. | 347/15 |
| 6,154,233 A | | 11/2000 | Breswick | 347/40 |
| 6,155,670 A | | 12/2000 | Weber et al. | 347/43 |
| 6,161,919 A | | 12/2000 | Klassen | 347/43 |
| 6,270,185 B1 | | 8/2001 | Askeland | 347/40 |
| 6,273,549 B1 | | 8/2001 | Wetchler et al. | 347/43 |
| 6,283,571 B1 | | 9/2001 | Zhou et al. | 347/15 |
| 6,293,643 B1 | | 9/2001 | Shimada et al. | 347/15 |
| 6,296,343 B1 | | 10/2001 | Alfaro | 347/43 |
| 6,299,284 B1 | | 10/2001 | Alfaro | 347/43 |
| 6,305,775 B1 | | 10/2001 | Ohtsuka et al. | 347/15 |
| 6,322,197 B1 | | 11/2001 | Yanaka | 347/41 |
| 6,511,143 B1 | * | 1/2003 | Ishikawa et al. | 347/9 |
| 2001/0006392 A1 | | 7/2001 | Otsuki | 347/9 |
| 2001/0030671 A1 | | 10/2001 | Fujimori | 347/19 |

FOREIGN PATENT DOCUMENTS

| | | | | |
|---|---|---|---|---|
| JP | 358012764 | * | 1/1983 | 347/43 |

* cited by examiner

*Primary Examiner*—Lamson Nguyen
(74) *Attorney, Agent, or Firm*—Taylor & Aust, PC

(57) ABSTRACT

A method of printing with an ink jet printer includes providing a printhead having a plurality of first nozzles with a first size and a plurality of second nozzles with a second size larger than the first size. The first nozzles and the second nozzles are alternatingly disposed in a vertical direction. Print data corresponding to first columns of pixel locations is provided. The print data includes for each pixel location in the first columns both a respective large dot print datum and a respective small dot print datum. One of the respective large dot print datum and the respective small dot print datum is printed at a first pixel location of the corresponding pixel locations in the first columns. Second columns of pixel locations interleaved with the first columns of pixel locations are provided. The other of the respective large dot print datum and the respective small dot print datum not printed in the first pixel location of the first columns is printed at a first pixel location of the second columns of pixel locations.

26 Claims, 12 Drawing Sheets

SUBCOVERED PRINTING MODE FOR A PRINTHEAD WITH MULTIPLE SIZED EJECTORS

BACKGROUND OF THE INVENTION

1. Field of the Invention

The present invention relates to an ink jet printer, and, more particularly, to a method of printing with high resolution using an ink jet printer.

2. Description of the Related Art

An ink jet printhead includes a plurality of nozzles arranged vertically, i.e., in the paper feed direction, with respect to a printed page. The nozzles have a fixed vertical spacing between them, such as 1/600 inch for a 600 dots per inch (dpi) printhead. Additionally, the array of nozzles travels horizontally repeatedly across the page, with some amount of advance of the paper in the vertical direction between such scans, dropping dots at a fixed horizontal distance, which can also be 1/600 inch. The term "horizontal", as used herein, indicates the direction of printhead scan, perpendicular to the vertical, paper feed direction. According to the present example, the vertical pitch of the nozzles, in combination with the horizontal distance between dots as they are placed on the page, define a printing grid, or matrix, of a given vertical and horizontal resolution.

Typically, the combined behavior of the horizontal scanning of the nozzle array and the amount of vertical paper feed between consecutive scans allows exactly one drop of ink to be placed at every pixel position of the printing grid. In this condition, the grid is said to be "perfectly covered." Each pixel position has one opportunity to be printed on exactly one scan of the printhead and by exactly one nozzle of the printhead.

The well known technique of "shingling" employs a method whereby the printing grid is "super covered", meaning that the horizontal scanning behavior and the vertical paper feed allow that each pixel position has multiple opportunities in which a drop of ink can be placed at that position. Typically, these multiple opportunities are available in different scans of the head, which implies that the multiple opportunities are realized by different nozzles of the printhead.

A problem is that multiple passes of the printhead over the same raster line decreases the print speed of the printer. Another problem is that the amount of information that can be transferred to the print medium is limited by the fact that only one size of ink drop can be deposited on the print medium. Thus, only through the selection of locations at which the single-sized ink drops are deposited can the information be conveyed to the print medium.

What is needed in the art is a method of transferring more information to the print medium without requiring more passes of the printhead.

SUMMARY OF THE INVENTION

The present invention provides a method of printing at a higher resolution with fewer passes of a multiple-sized-nozzle printhead.

The invention, in one form thereof, relates to a method of printing with an ink jet printer. A printhead having a plurality of first nozzles with a first size and a plurality of second nozzles with a second size larger than the first size is provided. The first nozzles and the second nozzles are alternatingly disposed in a vertical direction. Print data corresponding to first columns of pixel locations is provided. The print data includes for each pixel location in the first columns both a respective large dot print datum and a respective small dot print datum. One of the respective large dot print datum and the respective small dot print datum is printed at a first pixel location of the corresponding pixel locations in the first columns. Second columns of pixel locations interleaved with the first columns of pixel locations are provided. The other of the respective large dot print datum and the respective small dot print datum not printed in the first pixel location of the first columns is printed at a first pixel location of the second columns of pixel locations.

In another form thereof, the method includes the steps of providing a printhead having a plurality of first nozzles with a first size and a plurality of second nozzles with a second size larger than the first size; providing print data corresponding to first columns of pixel locations, the print data including both a respective large dot print datum and a respective small dot print datum corresponding to each pixel location in the first columns of pixel locations; printing one of the respective large dot print datum and the respective small dot print datum onto the each pixel location in the first columns; providing second columns of pixel locations interleaved with the first columns of pixel locations, each pixel location in the second columns corresponding to a respective pixel location in the first columns; and printing an other of the respective large dot print datum and the respective small dot print datum not printed in the first columns onto each the corresponding pixel locations in the second columns.

The invention, in another form thereof, relates to a method of printing with an ink jet printer. A printhead has a plurality of first nozzles with a first size and a plurality of second nozzles with a second size larger than the first size. The first nozzles and the second nozzles are alternatingly disposed in a vertical direction. A first set of pixel locations is defined that receives ink only from the first nozzles. A second set of pixel locations is defined that receives ink only from the second nozzles. The pixel locations from the first set and the pixel locations from the second set are alternatingly disposed in a horizontal direction. The first nozzles jet ink onto the first set of pixel locations. The second nozzles jet ink onto the second set of pixel locations.

The invention, in yet another form thereof, relates to a method of printing with an ink jet printer. A printhead has a plurality of first nozzles with a first size and a plurality of second nozzles with a second size larger than the first size. The first nozzles and the second nozzles are alternatingly disposed in a vertical direction. Each first nozzle is separated from an adjacent second nozzle by a first distance. A matrix of pixel locations is defined that includes a plurality of first pixel locations and a plurality of second pixel locations. The first pixel locations receive ink only from the first nozzles. The second pixel locations receiving ink only from the second nozzles. The matrix includes adjacent rows separated from each other by a second distance equal to one-half of the first distance. Pairs of the first pixel locations and pairs of the second pixel locations are alternatingly aligned in each vertical column of the matrix. The printhead jets ink onto the matrix of pixel locations.

The invention, in a further form thereof, relates to a method of printing with an ink jet printer. A printhead has a plurality of first nozzles with a first size and a plurality of second nozzles with a second size larger than the first size. The first nozzles and the second nozzles are alternatingly disposed in a vertical direction. Each first nozzle is separated from an adjacent second nozzle by a first distance in the vertical direction. A matrix of pixel locations is defined that includes a plurality of first pixel locations, a plurality of second pixel locations, and a plurality of third pixel locations. The first pixel locations receiving ink only from the first nozzles. The second pixel locations receiving ink only from the second nozzles. The third pixel locations receive ink from the first nozzles and the second nozzles. The matrix includes adjacent rows separated from each other by a second distance equal to one-half of the first distance. Each first pixel location is separated from at least one second pixel location by the first distance in the vertical direction. Each second pixel location is separated from at least one first pixel location by the first distance in the vertical direction. Each third pixel location is separated from at least one other third pixel location by the first distance in the vertical direction. The printhead jets ink onto the matrix of pixel locations.

An advantage of the present invention is that the large nozzles can fill in dark colors with fewer passes of the printhead, and the small nozzles can be used where less grain is needed.

Another advantage of the present invention is that more information is transferred to the print medium without requiring additional passes of the printhead.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate preferred embodiments of the invention, and such exemplifications are not to be construed as limiting the scope of the invention in any manner.

DETAILED DESCRIPTION OF THE INVENTION

Figure 1:
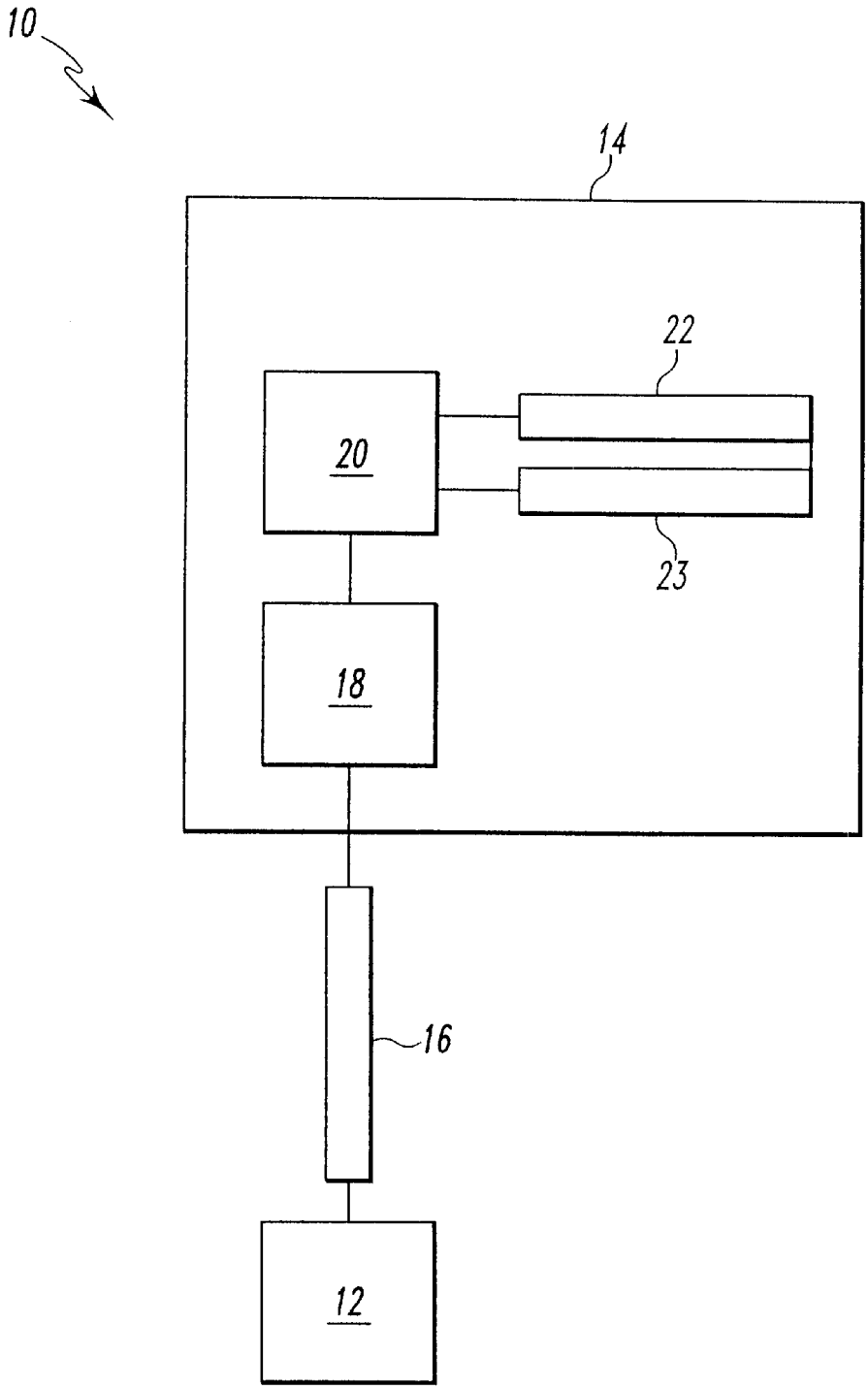
FIG. 1 is a block diagram of an ink jet printer incorporating the present invention.

Referring now to the drawings and particularly to FIG. 1, there is shown a schematic view of an ink jet printing system 10 including a host computer 12 and an ink jet printer 14. Host computer 12 is coupled to ink jet printer 14 via a bi-directional communications link 16. Communications link 16 can be effected, for example, using point-to-point electrical cable connections between serial or parallel ports of ink jet printer 14 and host computer 12, using an infrared transceiver unit at each of ink jet printer 14 and host computer 12, or via a network connection, such as an Ethernet network. Host computer 12 includes application software operated by a user, and provides image data representing an image to be printed, and printing command data, to ink jet printer 14 via communications link 16. During bi-directional communications, ink jet printer 14 supplies printer information, such as for example printer status and diagnostics information, to host computer 12 via communications link 16.

As shown schematically in FIG. 1, ink jet printer 14 includes a data buffer 18, a controller 20, a printhead carriage unit 22 and a print media sheet feed unit 23. The printing command data and image data received by ink jet printer 14 from host computer 12 are temporarily stored in data buffer 18. Controller 20, which includes a microprocessor with associated random access memory (RAM) and read only memory (ROM), executes program instructions to retrieve the print command data and printing data from data buffer 18, and processes the printing command data and image data. From the printing command data and the image data, controller 20 executes further instructions to effect the generation of control signals which are supplied to printhead carriage unit 22 and print media sheet feed unit 23 to effect the printing of the image on a print medium sheet, such as paper. The image data supplied by host computer 12 to ink jet printer 14 may be in a bit image format, wherein each bit of data corresponds to the placement of an ink dot of a particular color of ink at a particular pixel location in a rectilinear grid of possible pixel locations.

Figure 2:
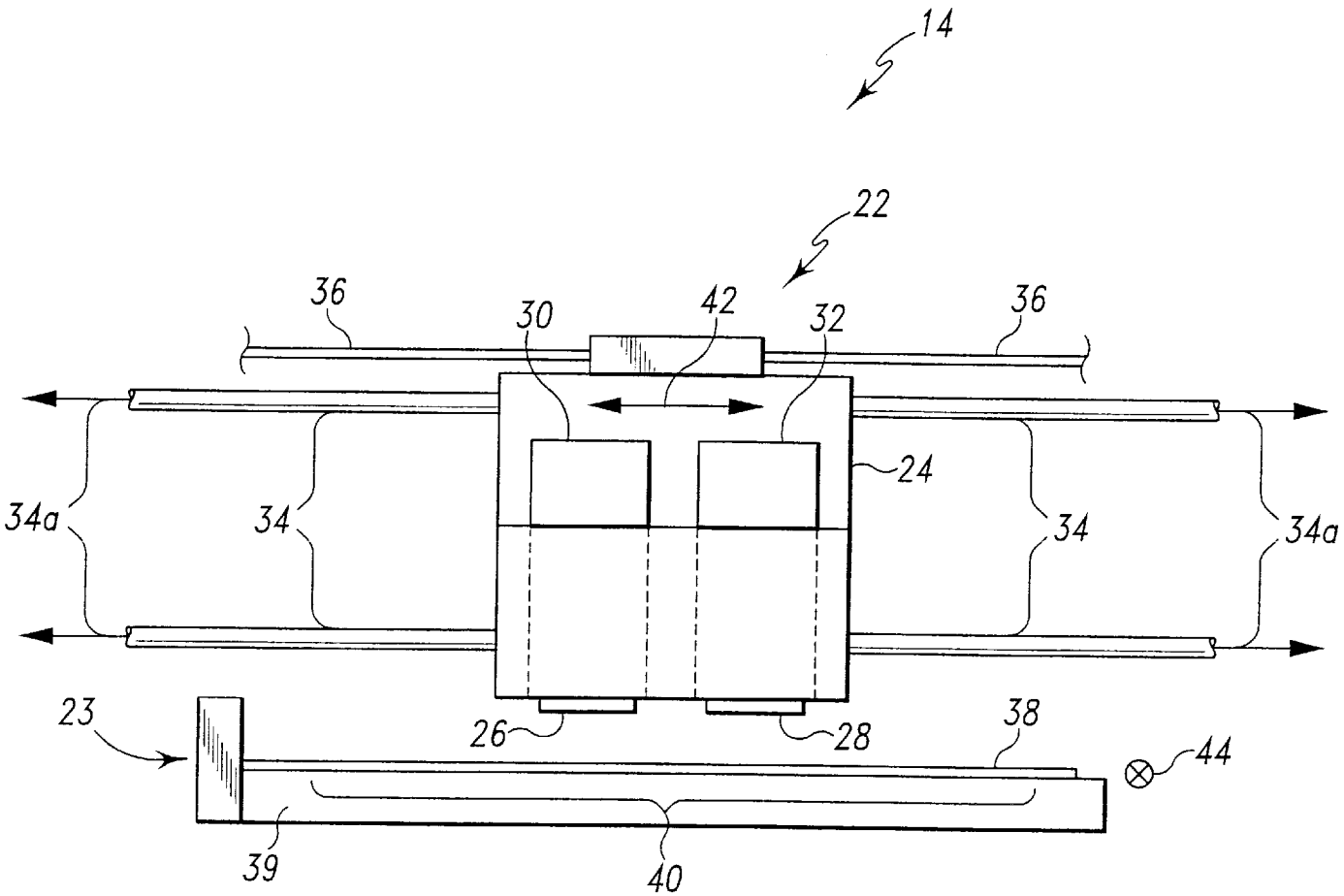
FIG. 2 is a front view of a portion of the ink jet printer of FIG. 1.

Referring to FIG. 2, printhead carriage unit 22 includes a printhead carrier 24 for carrying a color printhead 26 and a black printhead 28. A color ink reservoir 30 is provided in fluid communication with color printhead 26, and a black ink reservoir 32 is provided in fluid communication with black printhead 28.

Printhead carrier 24 is guided by a pair of guide rods 34. The axes 34*a* of guide rods 34 define a bi-directional scanning path for printhead carrier 24, and thus, for convenience the bidirectional scanning path will be referred to as bi-directional scanning path 34*a*. Printhead carrier 24 is connected to a carrier transport belt 36 that is driven by a carrier motor (not shown) to transport printhead carrier 24 in a reciprocating manner along guide rods 34. Thus, the reciprocation of printhead carrier 24 transports ink jet printheads 26, 28 across a print medium sheet 38, such as paper, along bidirectional scanning path 34*a* to define a print zone 40 of ink jet printer 14. This reciprocation occurs in a main scan direction 42 that is parallel with bi-directional scanning path 34*a*, and is also commonly referred to as the horizontal direction. During each scan of printhead carrier 24, print medium sheet 38 is held stationary by print media sheet feed unit 23. Print media sheet feed unit 23 includes an index roller 39 that incrementally advances the print medium sheet 38 in a sheet feed direction 44, also commonly referred to as a sub-scan direction or vertical direction, through print zone 40. As shown in FIG. 2, sheet feed direction 44 is depicted as an X within a circle to indicate that the sheet feed direction is in a direction perpendicular to the plane of FIG. 2, toward the reader. Sheet feed direction 44 is substantially perpendicular to main scan direction 42, and in turn, substantially perpendicular to bidirectional scanning path 34*a*. Printhead carriage unit 24 and printheads 26, 28 may be configured for unidirectional printing or bidirectional printing.

Depending upon the particular design of ink jet printer 14, color ink reservoir 30 may be fixedly attached to color printhead 26 so as to form a unitary color printhead cartridge. Alternatively, color ink reservoir 30 may be removably attached to color printhead 26 so as to permit the replacement of color ink reservoir 30 separate from the replacement of color printhead 26, and in this alternative color ink reservoir 30 is located on-carrier in close proximity to color printhead 26. In another alternative, color ink reservoir 30 may be located off-carrier at a location remote from color printhead 26.

Likewise, black ink reservoir 32 may be fixedly attached to black printhead 28 so as to form a unitary black printhead cartridge. Alternatively, black ink reservoir 32 may be removably attached to black printhead 28 so as to permit the replacement of black ink reservoir 32 separate from the replacement of black printhead 28, and in this alternative black ink reservoir 32 is located on-carrier in close proximity to black printhead 28. In another alternative, black ink reservoir 32 may be located off-carrier at a location remote from black printhead 28.

Figure 3:
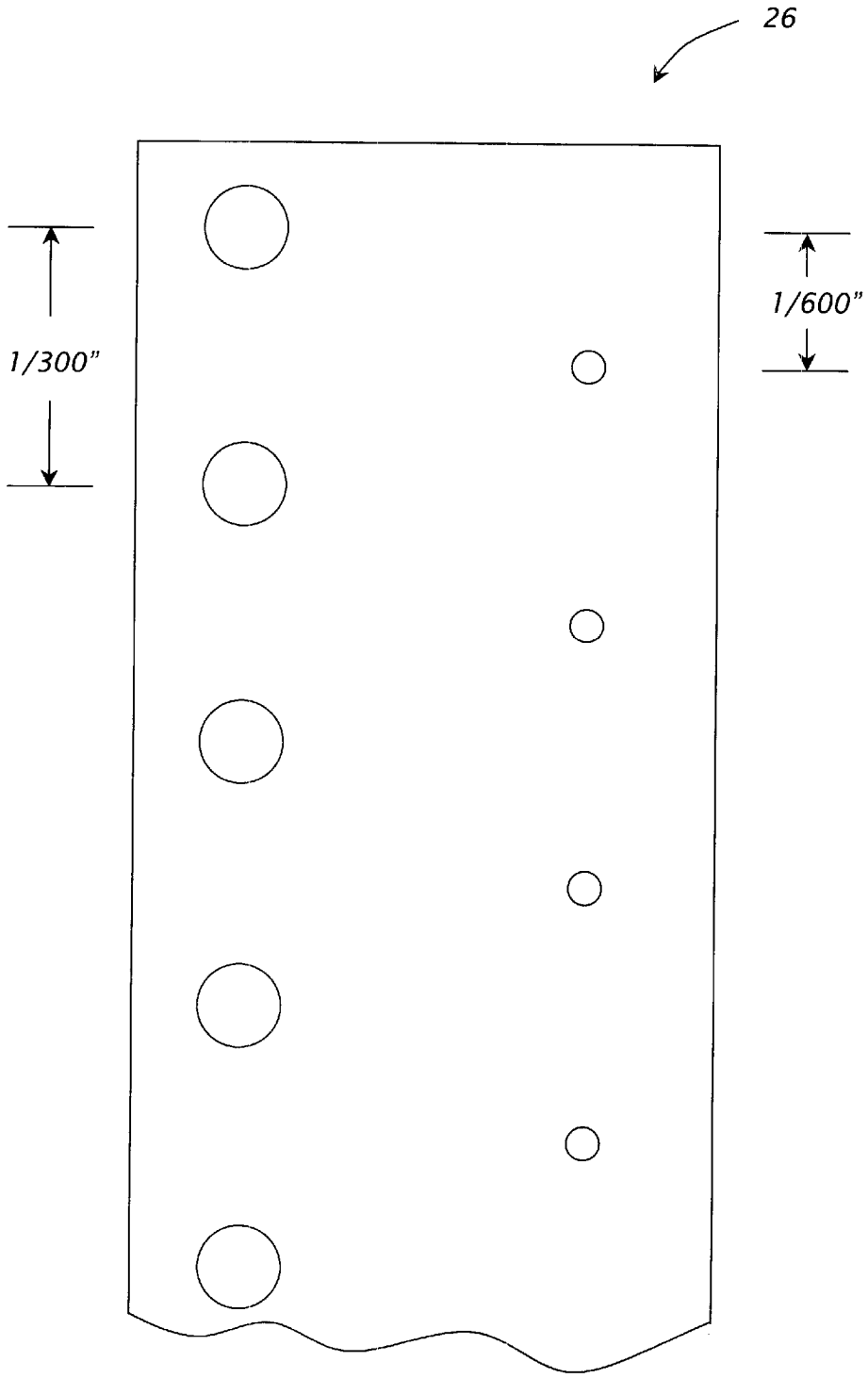
FIG. 3 is a fragmentary, schematic view of a printhead used in one embodiment of the method of the present invention.
Figure 4:
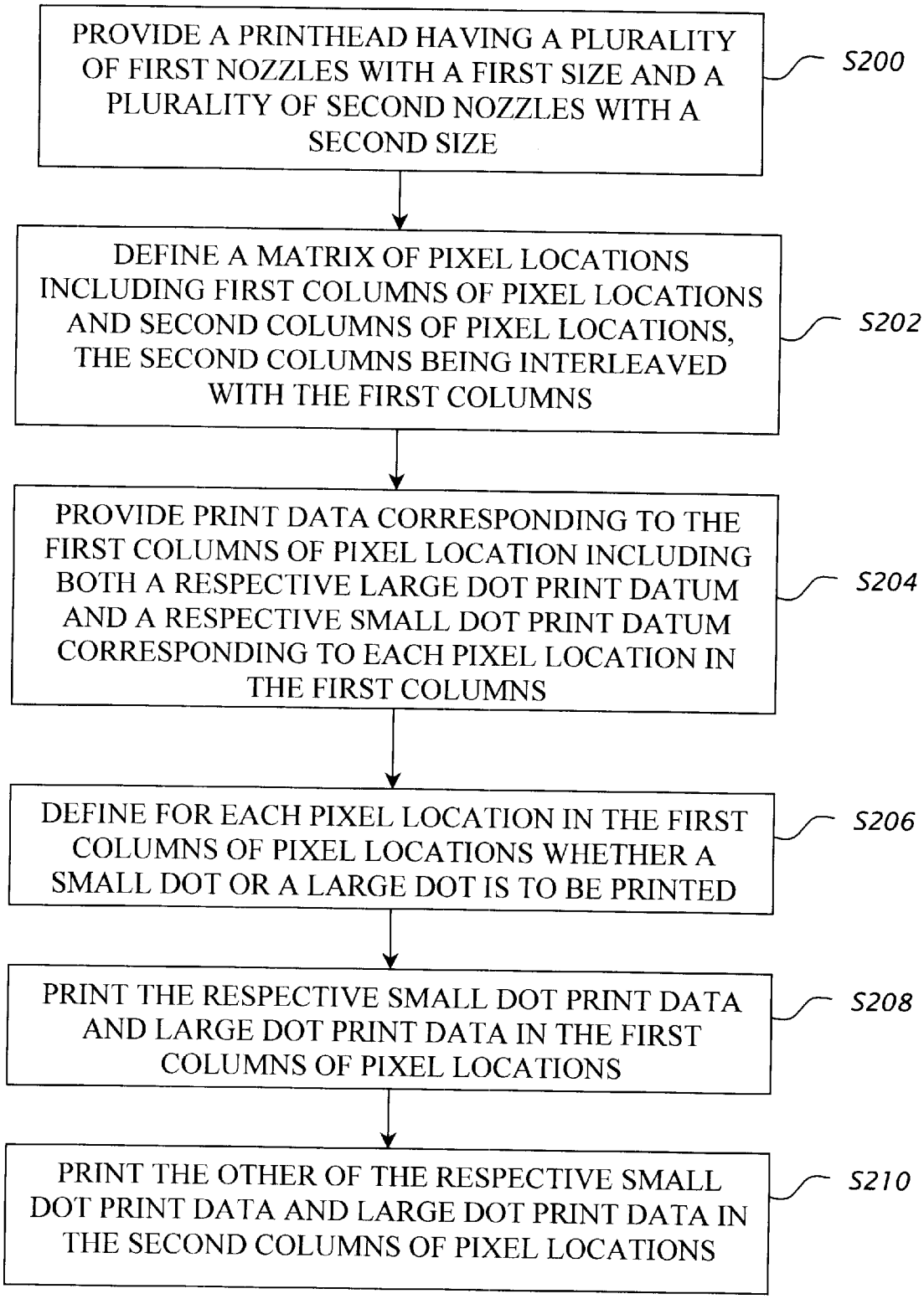
FIG. 4 is a flow chart of one embodiment of the method of the present invention.
Figure 5:
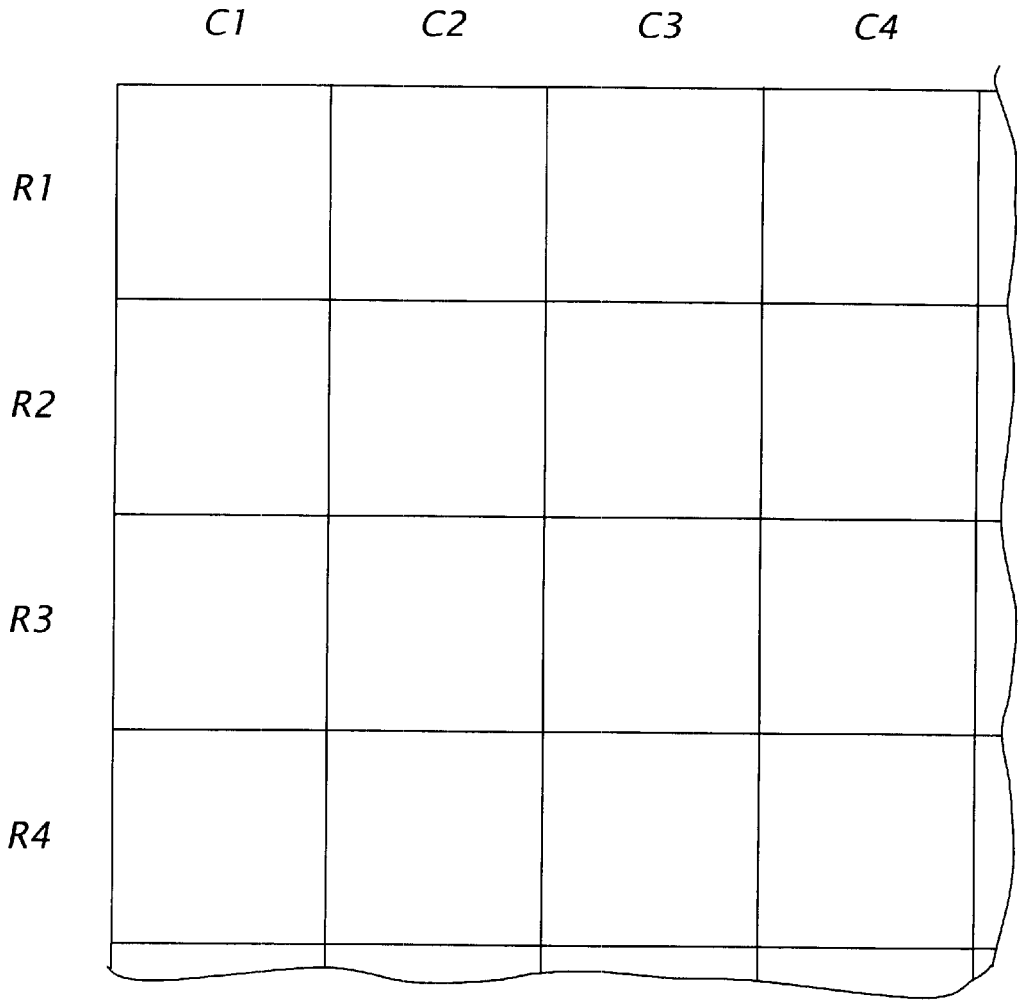
FIG. 5 is a fragmentary, schematic view of a matrix of pixel locations used in the method of th present invention.

A method of the invention will be described with reference to FIGS. 3–9. As can be seen in FIG. 3, printhead 26 has multiple sized nozzles within the nozzle array (Step S200; FIG. 4). The nozzles alternate in size along the vertical axis of printhead 26 at a fixed vertical pitch of 1/600 inch. That is, the large nozzles and small nozzles are alternatingly disposed in the vertical direction and each nozzle is separated from a vertically adjacent nozzle by 1/300 inch in the vertical direction. Nozzles of a given size are therefore 1/300 inch apart vertically. The two sizes of nozzles provide the imaging algorithms with an additional degree of freedom at each pixel position. Instead of a binary decision of either printing or not printing a drop of a given color of ink, the new degree of freedom allows the printing of no dot, a small dot, a large dot, or both a large and a small dot. This allows more information per unit area of the page to be rendered, which results in an image with more detail.

In order to define a "perfectly covered" print mode with a two-nozzle-size printing array, realizing that a perfectly covered mode requires that each pixel position has an opportunity to receive exactly one of each of both a big dot and a small dot, twice as many printing scans are required relative to a one-nozzle-size printing array. For example, on one scan of the printhead, due to the vertical nozzle spacing of the alternating large and small nozzles, the even rasters (rows of pixels) can receive only big dots, and the odd rasters can receive only small dots. A second scan must be made in which the even rasters receive small dots and the odd rasters receive big dots.

It has been found that in order to achieve acceptable print quality, "perfectly covered" or "super covered" print modes are not required. Instead, a "sub covered" print mode, in which some pixel positions receive only big dots and some positions receive only small dots, is acceptable. Halftoning algorithms, such as error diffusion, operate on every pixel position of a printing grid to determine whether or not a dot of a given size should be printed, and generally are designed to expect at least a "fully covered" printing capability to faithfully carry out the request of the halftone algorithm's choice. A "sub covered" print mode could simply eliminate or ignore the halftone algorithm's decision to print a dot of a given size at a given pixel position if that pixel position has been chosen to not be covered on any printing scan by any nozzle corresponding to the dot size. However, this would result in an objectionable print quality degradation in the form of additional grain.

An attempt could be made to solve the aforementioned problem by embedding knowledge in the halftone algorithm as to whether the printhead is operated in a fully covered print mode or a sub covered print mode. In the event that the image will be rendered with a sub covered print mode that allows each pixel position to receive one of a large drop or a small drop, but not both, the halftone algorithm could be made to realize which of only a big dot or a small dot a given pixel can possibly receive. Then, the halftone algorithm can be constructed so as to "know better" than to request at a given location the printing of a drop that cannot actually be printed at that location. However, halftone algorithms with such "intelligence" are not widely available. The present invention provides a printing method using a conventional halftoning algorithm in conjunction with a sub covered print mode. Grain is prevented since the sub covered print mode does not simply drop out dots that the halftone algorithm requests at positions at which such drops are not allowed.

The present invention provides a method of printing with a two-nozzle-size printhead in a "sub covered" print mode. A halftone algorithm generates a pattern at half of a desired final resolution, and another hardware or software functional block takes the results from the halftone algorithm and shifts dots to produce the desired final resolution.

As used herein, the term "printing" data includes deciding whether to jet ink from nozzles onto pixel locations depending upon values of each respective print datum, the values each being, e.g., 0 or 1. Thus, ink is jetted onto selected ones of the pixel locations.

A single pass of printhead 26 prints on a 600×600 dpi grid, or matrix, (FIG. 5), so that drops of ink are spaced apart by a horizontal distance of 1/600 inch. The first half of the horizontal rasters, spaced 1/300 inch apart vertically, can receive only large drops. The other, second half of the horizontal rasters, also spaced 1/300 inch apart vertically and interleaved between the first half of rasters, can receive only small drops. By assumption, the first half of rasters (large drops) correspond to even rasters on the 600×600 dpi grid, and the second half of rasters (small drops) correspond to odd rasters on the 600×600 dpi grid.

A print mode that has "perfect coverage" requires two passes for every 600×600 dpi grid multiplied by the number of passes required to get any higher resolution. For example, a 4800×1200 dpi "perfectly covered" print mode requires 32 passes: 8 passes to get 4800 dpi horizontal resolution, times 2 passes to get 1200 dpi vertical resolution, times 2 passes for "perfect coverage". The 4800×1200 dpi print mode, if implemented in such a way as to accomplish "perfect coverage", has slow performance for two reasons. First, a halftone generating 4800×1200 dpi rasters is computationally expensive. Second, printing in 32 passes is also very slow. The present invention addresses both speed issues.

Consider a 4800×1200 dpi print mode. The halftone algorithm generates 2400×1200 dpi binary raster data by methods known to those skilled in the art. The halftone algorithm has no prior knowledge of where large and small drops can be placed. The halftone algorithm chooses no drops, a single small drop, a single large drop, or both a large and a small drop at each 2400×1200 dpi location. These data are then "separated" to make 4800×1200 dpi binary raster data. This is done by expanding each 2400 dpi horizontal raster into a 4800 dpi horizontal raster with alternating exclusively large and small drop locations.

Figure 6:
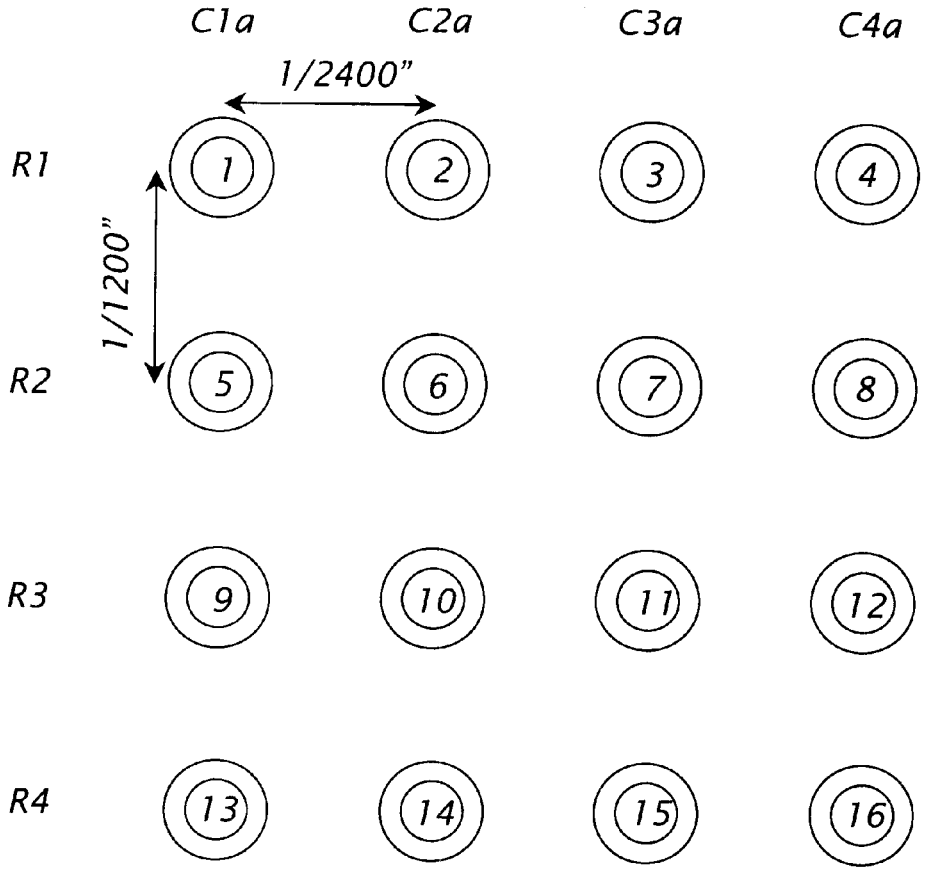
FIG. 6 is a schematic view of pixel locations printed upon by the printhead of FIG. 3.
Figure 7:
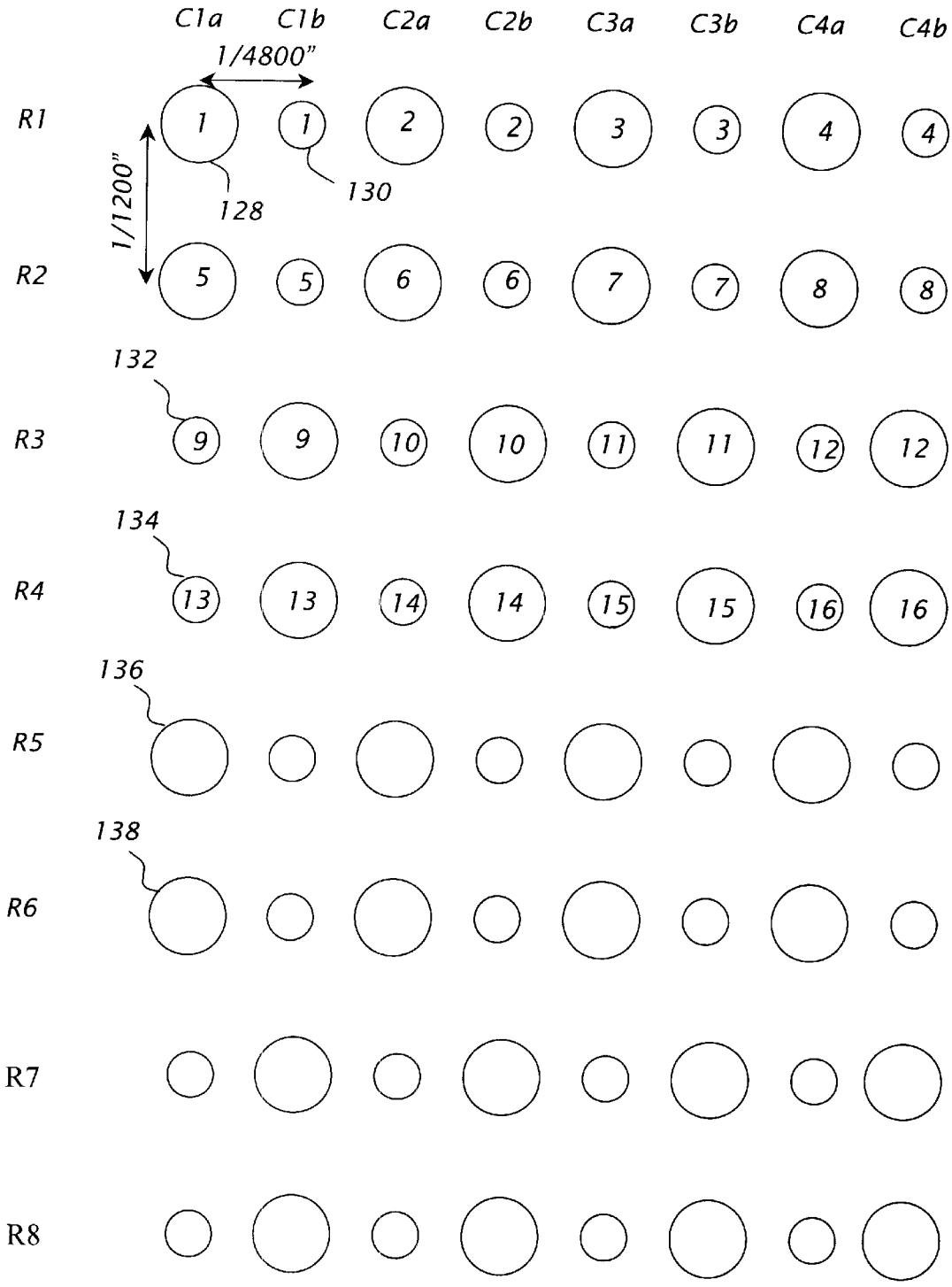
FIG. 7 is a schematic view of pixel locations printed upon by the printhead of FIG. 3 using one embodiment of the method of the present invention.

A sample of pixel locations corresponding to the 2400×1200 binary raster data generated by the halftone algorithm is shown in FIG. 6. The print data corresponds to the pixel locations of FIG. 6. The small circles represent potential locations for small ink drops and the large circles represent potential locations for large ink drops. The halftone data are "separated" to make 4800×1200 dpi data corresponding to the matrix of pixel locations shown in FIG. 7. The numbers within the pixel locations illustrate the correspondence between adjacent pixel locations. FIG. 7 shows a matrix of pixel locations conjunctively formed by second columns of pixel locations, for example C1*b*, C2*b*, etc., interleaved between the first columns of pixel locations C1*a*, C2*a*, etc. that are shown in FIG. 6 (Step S202).

The halftone data includes a plurality of binary bits, with each bit or "datum" indicating whether a dot should be placed at a respective pixel location. Both a respective large dot print datum and a respective small dot print datum correspond to each pixel location of the first columns C1*a*, C2*a*, etc., shown in FIG. 6 (Step S204). The separation of the halftone data separates the large dot print data from the small dot print data such that only a respective large dot print datum or a respective small dot print datum corresponds to each pixel location of FIG. 7. Adjacent rows of pixel locations in the matrix of FIG. 7 are separated from each other by $1/1200$ inch, i.e., half the vertical distance separating adjacent nozzles on printhead 26.

Figure 8:
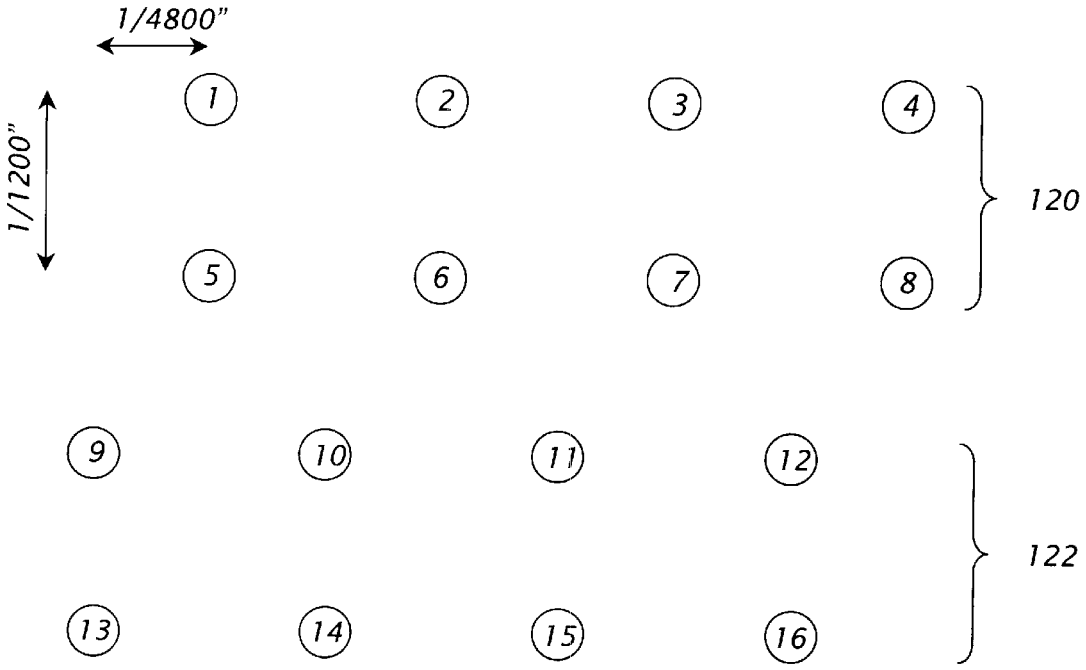
FIG. 8 is a schematic view of a first set of the pixel locations of FIG. 7.
Figure 9:
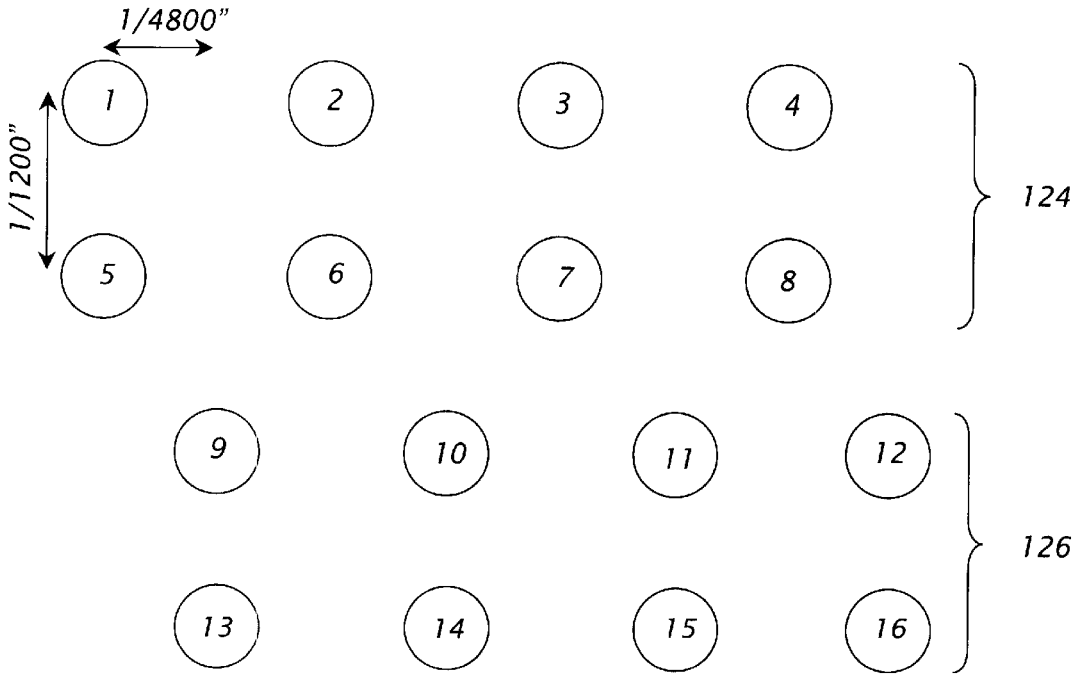
FIG. 9 is a schematic view of a second set of the pixel locations of FIG. 7.

The small dot pixel locations of FIG. 7 can be considered a first set of pixel locations, partially shown in FIG. 8. The first set of pixel locations includes pairs of horizontal rows of pixel locations, such as pair 120 and adjacent pair 122. Pair 122 is horizontally staggered from pair 120 by a distance of $1/4800$ inch, which is one-half a distance of $1/2400$ inch between horizontally adjacent pixels in the first set. The large dot pixel locations of FIG. 7 can be considered a second set of pixel locations, partially shown in FIG. 9. As best seen in FIG. 7, pixel locations from the first set and pixel locations from the second set are alternatingly disposed in the horizontal direction. The second set of pixel locations includes pairs of horizontal rows of pixel locations, such as pair 124 and adjacent pair 126. Pair 126 is horizontally staggered from pair 124 by a distance of $1/4800$ inch, which is one-half a distance of $1/2400$ inch between horizontally adjacent pixels in the second set. The small nozzles are used to jet ink onto the first set of pixel locations. The large nozzles are used to jet ink onto the second set of pixel locations.

Each pixel location in the second set corresponds to a pixel location in the first set. As is evident from FIG. 7, the large dot pixel locations are intermixed with the small dot pixel locations.

The pattern of FIG. 7 is repeated horizontally and vertically for the remainder of the raster data. The separated data of FIG. 7 has the advantage of having a higher resolution than the data of FIG. 6, and thus results in a better print quality.

For each pixel location in the first columns C1*a*, C2*a*, etc. of pixel locations, it is defined whether a small dot or a large dot is to be printed (Step S206). For example, a respective large dot print datum may be printed at a first corresponding pixel location of the first columns C1*a*, C2*a*, etc. of pixel locations, i.e., at pixel location 128 in column C1*a*. Respective small dot print data and large dot print data are printed in first columns C1*a*, C2*a*, etc. (Step S208). For this example, it is assumed that the print data will form an ink dot at each pixel location in the first columns.

The second columns of pixel locations, such as C1*b*, C2*b*, etc., are interleaved with the first columns of pixel locations, such as C1*a*, C2*a*, etc. For example, the separated respective small dot print datum is printed at a first corresponding pixel location of the second columns of pixel locations, i.e., at pixel location 130. In other words, respective separated data not printed in first columns C1*a*, C1*b*, etc., which may also be small dot print data and large dot print data, are printed in second columns C1*b*, C2*b*, etc. (Step S210).

As shown in FIG. 7, there is a repeating vertical pattern of two large dots, two small dots, two large dots, two small dots, etc., with vertically adjacent dots being separated by $1/1200$ inch. That is, pairs of pixel locations from the first set, such as pixel locations 132 and 134, and pairs of pixel locations from the second set, such as pixel locations 136 and 138, are alternatingly aligned in each vertical column. The repeating vertical pattern of two large drops and then two small drops is to accommodate the fact that printhead 26 has vertically alternating small and large nozzles spaced $1/600$ inch apart. Thus, in order to minimize the number of required passes of printhead 26 to jet ink onto the matrix of pixel locations and thereby place all of the drops, anytime a large drop is placed, only small drops can be placed $1/600$ inch above and below the large drop. Similarly, anytime a small drop is placed, only large drops can be placed $1/600$ inch above and below the small drop.

In another embodiment, non-integer multiples of resolution are achieved. By this it is meant, for example, that the driver reports a certain resolution to the application, say 1200 dpi, and desires to generate data at a resolution of 1800 dpi. Generating data at such a non-integer multiple of the original resolution of 1200 dpi falls beyond the scope of typical halftoning algorithms.

Because the spacing of the nozzles in the vertical paper feed direction is 600 dpi, and assuming paper feeds have been geared to provide 600 or 1200 dpi, a resolution of 600 or 1200 dpi, in both the horizontal and vertical directions, is reported to an application, such as a word processing program. When it is desired to achieve some horizontal resolution that is an odd multiple of the reported resolution, such as 1800 dpi, a different technique is needed. Among horizontal resolutions higher than that reported to the application, the easiest ones to achieve are those that are larger than the resolution reported to the application by multiples of two, since there are two sizes of nozzles. A resolution of 1800 dpi is either 3 or 1.5 times larger than the resolution reported to the application.

The first embodiment described above provides a method for processing 2400×1200 dpi data, assuming a "perfectly covered" print mode for a two nozzle size printhead (i.e., each location can receive one of each size drop), using traditional halftoning algorithms or techniques, yet yielding a 4800×1200 dpi printed output that is "sub-covered" (i.e., each location can receive either one or the other size drop). In this first embodiment, the driver can report a resolution of 1200 dpi to the application.

It may also be desirable to achieve an odd multiple of the reported resolution of 1200 dpi, such as 3600×1200 dpi printed output. According to the first embodiment described above, this would imply processing the data as a "perfectly covered" 1800×1200 dpi print mode, then expanding as described to obtain the 3600×1200 dpi printed output. However, traditional halftoning algorithms are not designed to process the data as 1800×1200 dpi, when reporting 1200 dpi to the application, as effectively and as efficiently as an integer or a power-of-two multiple.

The second embodiment described below not only provides a printing method (see FIGS. 10 and 11) using a conventional halftoning algorithm in conjunction with a sub-covered print mode, but also provides a method for achieving varying print resolutions using a conventional halftoning algorithm. This second embodiment provides a method of printing with a two-nozzle-size printhead in a "sub covered" print mode whereby halftone generates a pattern at, for example, two-thirds of the desired resolution and another hardware or software functional block takes the results from the halftone algorithm and shifts dots to achieve the desired resolution.

Figure 10:
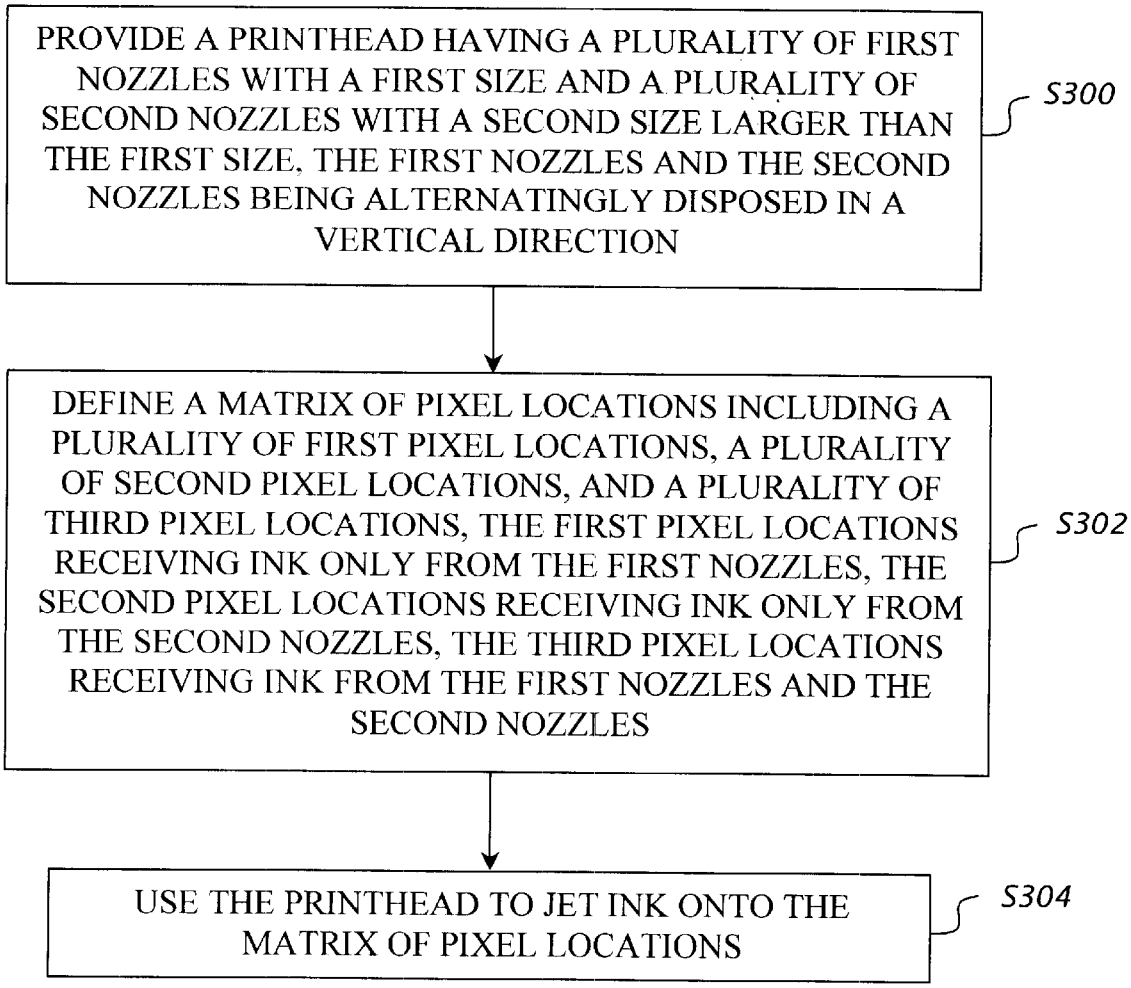
FIG. 10 is a flow chart of another embodiment of the method of the present invention.
Figure 11:
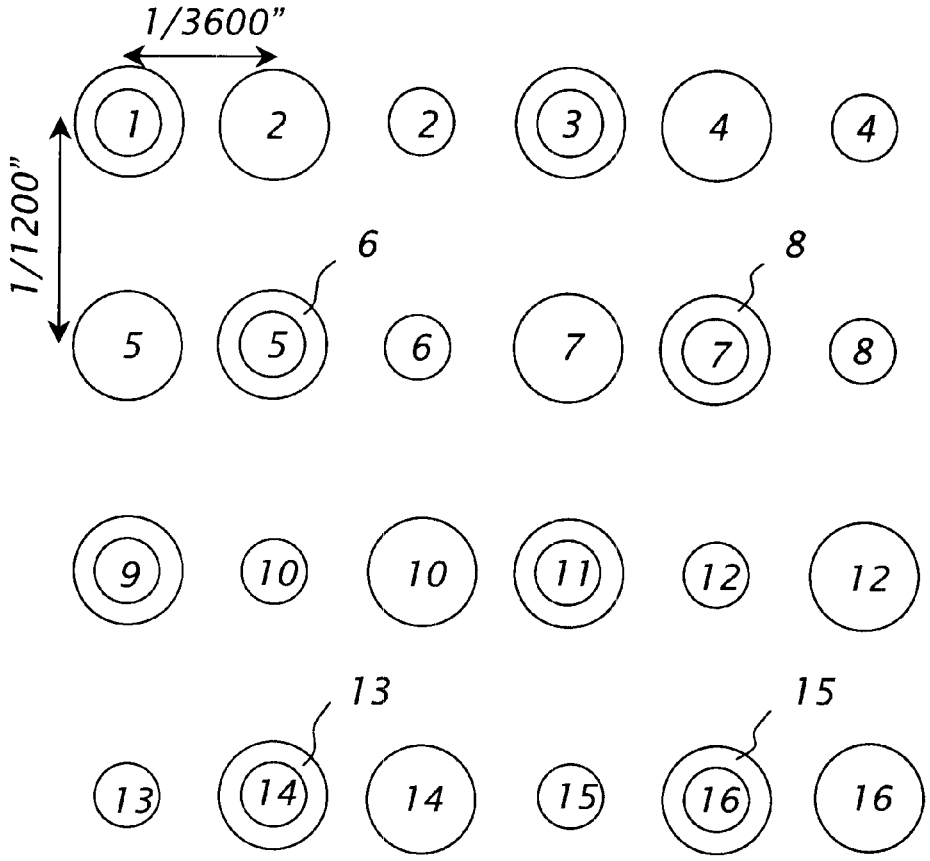
FIG. 11 is a schematic view of pixel locations printed upon by the printhead of FIG. 3 using another embodiment of the method of the present invention.

The same printhead 26 shown in FIG. 3 is used. Printhead 26 has small nozzles and large nozzle alternatingly disposed in a vertical direction (Step S300; FIG. 10). The halftone algorithm generates 2400×1200 dpi binary raster data, corresponding to the pixel locations shown in FIG. 6. The halftone algorithm has no prior knowledge of where large and small drops can be placed. The halftone algorithm chooses no drops, a single small drop, a single large drop, or both a large and a small drop at each 2400×1200 dpi location. This data is then "separated" to make 3600×1200 dpi binary raster data by expanding each 2400 dpi horizontal raster into a 3600 dpi horizontal raster. The eight dots in four columns shown in each row of FIG. 6 are spaced apart into eight dots in six columns, as shown in the matrix of pixel locations of FIG. 11. FIG. 11 shows the halftone data after it has been "separated" to make 3600×1200 dpi data. Some pixel locations can receive both a large dot and a small dot, some pixel locations can receive only a large dot, and other pixel locations can receive only a small dot (Step S302). Thus, this mode is between a sub-covered mode and a perfectly covered mode. Adjacent rows are separated from each other by 1/1200 inch, i.e., one-half the vertical distance between adjacent nozzles.

The numbers inside the circles in FIG. 11 refer back to FIG. 6. A single number inside two concentric circles indicates that the number applies to both circles. When there are two numbers, the number inside the small circle identifies the small circle and the number outside the small circle identifies the large circle. The vertical pattern of pixel locations is reflective of the fixed relationship between small and large nozzles in the printhead which forces a small drop to be located 1/600 inch vertically from a large drop and vice versa. Thus, in order to minimize the number of passes required to place all of the drops, each small drop pixel location is separated from at least one large drop pixel location by 1/600 inch in the vertical direction, and each large drop pixel location is separated from at least one small drop pixel location by 1/600 inch in the vertical direction. Moreover, each pixel location that can receive a small drop and/or a large drop is separated from at least one other pixel location that can receive a small drop and/or a large drop by 1/600 inch in the vertical direction. All three of these types of pixel locations are intermixed with each other in the matrix. Also, the three types of pixel locations are alternatingly aligned in each horizontal row of the matrix. That is, each pixel location is separated from another pixel location of its own type by three pixel locations in the horizontal direction. Printhead 26 is used to jet ink onto the matrix of pixel locations (Step S304).

The particular arrangement of pixel locations shown in FIG. 11 is simple to implement and spreads the pixel locations horizontally as evenly as possible. The eight dots indicated in each row of FIG. 6 map into six horizontal locations, as shown in FIG. 11.

Figure 12:
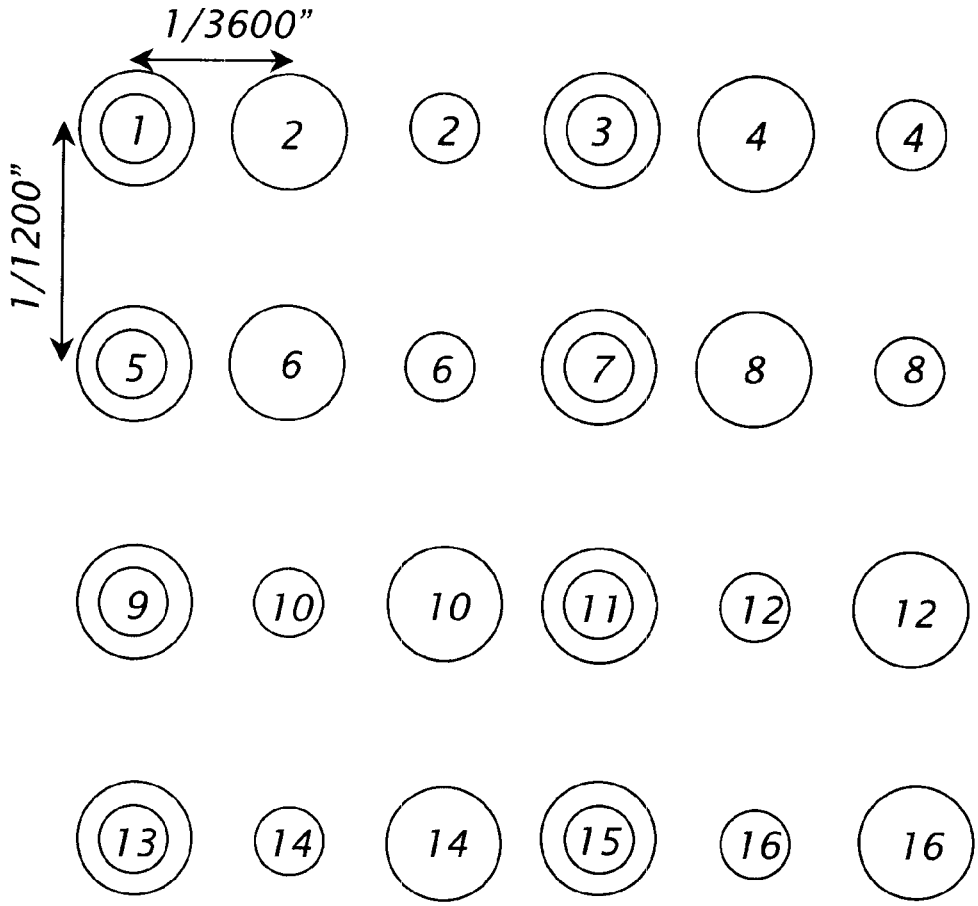
FIG. 12 is a schematic view of pixel locations printed upon by the printhead of FIG. 3 using yet another embodiment of the method of the present invention.

A third embodiment of the present invention is shown in FIG. 12. The discussion above with regard to FIG. 11 applies equally as well to FIG. 12.

Compared to the 4800 dpi case described in the first embodiment, the second and third embodiments provide for a 3600 dpi print mode that utilizes the same data from the halftoning algorithm as the 4800 dpi case. This is accomplished by combining portions of each of the eight columns of FIG. 9 in the 4800 dpi mode to fit into the six columns of the 3600 dpi mode. The resultant 3600 dpi mode provides a print quality advantage over a true sub-covered 3600 dpi mode, while providing a speed advantage over a perfectly covered 3600 dpi print mode.

Another advantage of the present invention is that it can be easily extended to different printers to provide them with varying print resolutions. For instance the present invention is easily extended to 3000 or 4200 dpi resolution.

The present invention has been described as being implemented using color printhead 26. However, the present invention can also be implemented using black printhead 28.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A method of printing with an ink jet printer, comprising the steps of:

providing a printhead having a plurality of first nozzles with a first size and a plurality of second nozzles with a second size larger than said first size, said first nozzles and said second nozzles being alternatingly disposed in a vertical direction;

providing print data corresponding to first columns of pixel locations, the print data including for each pixel location in said first columns both a respective large dot print datum and a respective small dot print datum;

printing one of said respective large dot print datum and said respective small dot print datum at a first pixel location of said pixel locations in said first columns;

providing second columns of pixel locations interleaved with said first columns of pixel locations; and printing an other of said respective large dot print datum and said respective small dot print datum not printed in said first pixel location of said first columns at a first pixel location of said second columns of pixel locations.

2. The method of claim 1, wherein the printing steps are performed for each pixel location in said first columns and said second columns.

3. The method of claim 1, wherein said first columns of pixel locations and said second columns of pixel locations conjunctively form a matrix of pixel locations.

4. The method of claim 1, wherein each said pixel location in said second columns corresponds to a respective pixel location in said first columns.

5. The method of claim 4, wherein each said pixel location in said second columns is adjacent to said corresponding respective pixel location in said first columns.

6. A method of printing with an ink jet printer, comprising the steps of:

providing a printhead having a plurality of first nozzles with a first size and a plurality of second nozzles with a second size larger than said first size;

providing print data corresponding to first columns of pixel locations, the print data including both a respective large dot print datum and a respective small dot print datum corresponding to each pixel location in said first columns of pixel locations;

printing one of said respective large dot print datum and said respective small dot print datum onto said each pixel location in said first columns;

providing second columns of pixel locations interleaved with said first columns of pixel locations, each pixel location in said second columns corresponding to a respective said pixel location in said first columns; and printing an other of said respective large dot print datum and said respective small dot print datum not printed in said first columns onto each said corresponding pixel location in said second columns.

7. A method of printing with an ink jet printer, comprising the steps of:

providing a printhead having a plurality of first nozzles with a first size and a plurality of second nozzles with a second size larger than said first size, said first nozzles and said second nozzles being alternatingly disposed in a vertical direction;

defining a first set of pixel locations receiving ink only from said first nozzles;

defining a second set of pixel locations receiving ink only from said second nozzles, said pixel locations from said first set and said pixel locations from said second set being alternatingly disposed in a horizontal direction;

using said first nozzles to jet ink onto said first set of pixel locations; and using said second nozzles to jet ink onto said second set of pixel locations.

8. The method of claim 7, wherein each said pixel location in said second set corresponds to a respective pixel location in said first set.

9. The method of claim 7, wherein said first set of pixel locations and said second set of pixel locations conjunctively form a matrix of pixel locations.

10. The method of claim 9, wherein said second set of pixel locations is intermixed with said first set of pixel locations.

11. The method of claim 9, wherein said matrix includes a plurality of vertical columns, pairs of said pixel locations from said first set and pairs of said pixel locations from said second set being alternatingly aligned in each vertical column of said plurality of columns.

12. The method of claim 7, wherein said first set of pixel locations includes a plurality of pairs of horizontal rows of pixel locations, adjacent ones of said pairs of rows being horizontally staggered relative to each other.

13. The method of claim 12, wherein a length of said stagger is less than a distance between horizontally adjacent ones of said pixel locations of said first set.

14. The method of claim 12, wherein said second set of pixel locations includes a plurality of pairs of horizontal rows of pixel locations, adjacent ones of said pairs of rows of said second set being horizontally staggered relative to each other.

15. A method of printing with an ink jet printer, comprising the steps of:

providing a printhead having a plurality of first nozzles with a first size and a plurality of second nozzles with a second size larger than said first size, said first nozzles and said second nozzles being alternatingly disposed in a vertical direction, each said first nozzle being separated from an adjacent said second nozzle by a first distance in the vertical direction;

defining a matrix of pixel locations including a plurality of first pixel locations and a plurality of second pixel locations, said first pixel locations receiving ink only from said first nozzles, said second pixel locations receiving ink only from said second nozzles, said matrix including adjacent rows separated from each other by a second distance equal to one-half of said first distance, pairs of said first pixel locations and pairs of said second pixel locations being alternatingly aligned in each vertical column of said matrix; and using said printhead to jet ink onto said matrix of pixel locations.

16. The method of claim 15, wherein said first pixel locations and said second pixel locations are intermixed with each other.

17. The method of claim 15, wherein said first pixel locations and said second pixel locations are alternatingly aligned in each horizontal row of said matrix.

18. The method of claim 15, wherein said first distance is approximately between $1/300$ inch and $1/1200$ inch.

19. The method of claim 15, wherein said matrix includes adjacent columns separated from each other by a third distance, said first distance being at least eight times larger than said third distance.

20. The method of claim 15, wherein each said first pixel location is separated from at least one said second pixel location by said first distance in the vertical direction.

21. The method of claim 20, wherein each said second pixel location is separated from at least one said first pixel location by said first distance in the vertical direction.

22. A method of printing with an ink jet printer, comprising the steps of:

providing a printhead having a plurality of first nozzles with a first size and a plurality of second nozzles with a second size larger than said first size, said first nozzles and said second nozzles being alternatingly disposed in a vertical direction, each said first nozzle being separated from an adjacent said second nozzle by a first distance in the vertical direction;

defining a matrix of pixel locations including a plurality of first pixel locations, a plurality of second pixel locations, and a plurality of third pixel locations, said first pixel locations receiving ink only from said first nozzles, said second pixel locations receiving ink only from said second nozzles, said third pixel locations receiving ink from said first nozzles and said second nozzles, said matrix including adjacent rows separated from each other by a second distance equal to one-half of said first distance, each said first pixel location being separated from at least one second pixel location by said first distance in the vertical direction, each said second pixel location being separated from at least one first pixel location by said first distance in the vertical direction, each said third pixel location being separated from at least one other said third pixel location by said first distance in the vertical direction; and using said printhead to jet ink onto said matrix of pixel locations.

23. The method of claim 22, wherein said first pixel locations, said second pixel locations and said third pixel locations are intermixed with each other.

24. The method of claim 22, wherein said first pixel locations, said second pixel locations and said third pixel locations are alternatingly aligned in each horizontal row of said matrix.

25. The method of claim 22, wherein said first distance is approximately between $1/300$ inch and $1/1200$ inch.

26. The method of claim 22, wherein said matrix includes adjacent columns separated from each other by a third distance, said first distance being at least six times larger than said third distance.

* * * * *

UNITED STATES PATENT AND TRADEMARK OFFICE

CERTIFICATE OF CORRECTION

PATENT NO. : 6,592,203 B1
DATED : July 15, 2003
INVENTOR(S) : Bates et al.

It is certified that error appears in the above-identified patent and that said Letters Patent is hereby corrected as shown below:

Column 11 through Column 14,
Please delete the cancelled claims 7-26.

Signed and Sealed this

Fifth Day of October, 2004

JON W. DUDAS
*Director of the United States Patent and Trademark Office*